United States Patent [19]

Herbert

[11] Patent Number: 4,559,759

[45] Date of Patent: Dec. 24, 1985

[54] CAPPING MACHINES FOR CONTAINERS

[75] Inventor: James F. Herbert, Staffordshire, England

[73] Assignee: Metal Closures Limited, West Midlands, England

[21] Appl. No.: 541,535

[22] Filed: Oct. 13, 1983

[30] Foreign Application Priority Data

Oct. 18, 1982 [GB] United Kingdom ..... 8229676

[51] Int. Cl.[4] ..... B67B 3/20; B67B 1/06

[52] U.S. Cl. ..... 53/308; 53/317; 53/331.5

[58] Field of Search ..... 53/306, 308, 312, 317, 53/331, 331.5

[56] References Cited

U.S. PATENT DOCUMENTS

| | | | |
|---|---|---|---|
| 1,748,961 | 3/1930 | Risser | 53/308 |
| 1,888,470 | 11/1932 | Risser | 53/331 |
| 2,082,048 | 6/1937 | Everett | 53/317 |
| 2,310,868 | 2/1943 | Price | 53/308 |
| 2,876,606 | 3/1959 | Bjering | 53/317 |
| 3,852,941 | 12/1974 | Bross | 53/317 |
| 4,308,707 | 1/1982 | Willingham | 53/314 |

FOREIGN PATENT DOCUMENTS 1073442 9/1954 France .

OTHER PUBLICATIONS

"France—They Cap the Lot! says a Special Correspondent", *International Bottler and Packer,* Jul., 1982, pp. 47–50.

*Primary Examiner*—Robert L. Spruill
*Assistant Examiner*—Richard Mudd
*Attorney, Agent, or Firm*—Roland T. Bryan

[57] ABSTRACT

For placing prethreaded closure caps on the mouths of screw threaded bottles and effecting preliminary engagement of the caps with the threads of the bottles, the caps are withdrawn successively from a feed chute and supplied to suction pick-up members, which are individually supported by brackets, turning about the center of a star wheel. The brackets are supported by a cam track which raises and lowers the suction pick-up members, which carry the caps on their lower surface. The caps are thus lowered onto the bottles in a level condition and are held level by the pick-up members during preliminary engagement of the caps with the bottle threads. The caps are conveniently rotated by rotating the pick-up members in their brackets through contact with a stationary friction or rack member.

9 Claims, 4 Drawing Figures

Figure 1:
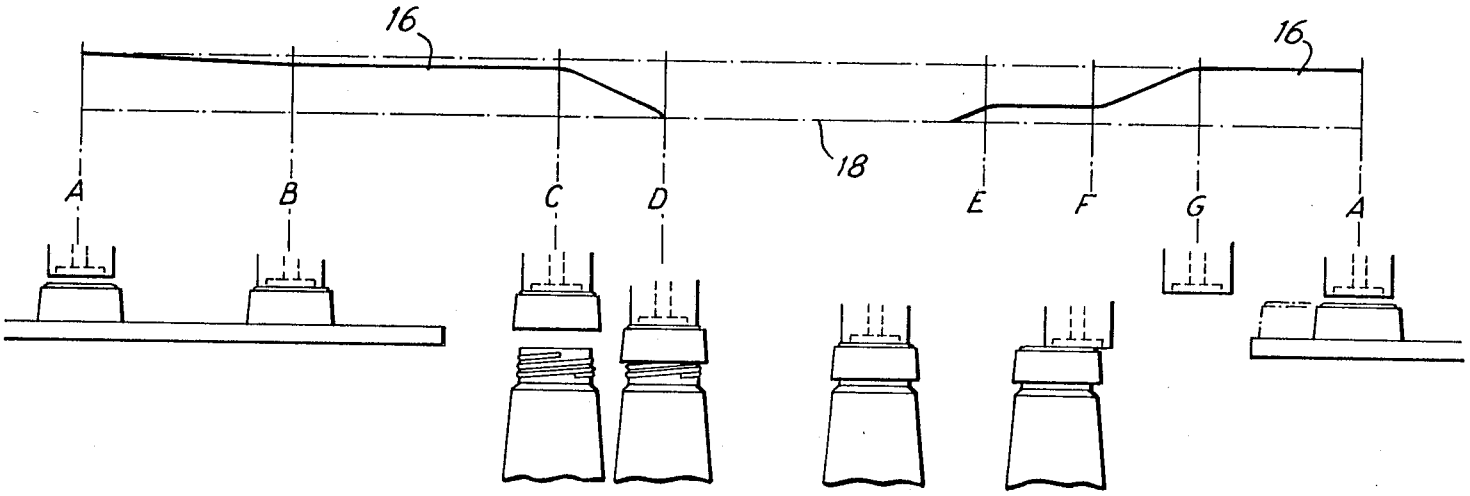

1
2
7
8
9
11
12
14
15
16
17
19
20
21
22
23
24
25
26
27
28
29
30

CAPPING MACHINES FOR CONTAINERS

The present invention relates to the application of closure caps to containers having externally screw-threaded necks.

In the application of unthreaded metal closures to such containers, in a commonly used system a cup-shaped blank is picked up by the bottle as it passes a feed chute.

In the existing procedure for feeding unthreaded metal or threaded plastic closure blanks the containers are travelling continuously or by indexed steps when passing under the feed chute. The containers may be moving in an arcuate path in a star wheel or may be travelling on a linearly moving conveyor.

The leading blank in the feed chute projects from the feed end of the chute and the chute is somewhat inclined to the direction in which the containers travel so that the top end of the bottle neck just strikes the inside of the closure blank skirt and draws the blank out of the chute, while passing under a hold-down plate which is progressively curved to an essentially horizontal position beyond the exit end of the chute. That arrangement works satisfactorily for feeding unthreaded blanks, since the internal diameter of the closure skirt is greater than the diameter of the bottle neck over the threads.

When this system is employed for feeding internally pre-threaded closures, such as moulded plastic closures, considerable inconvenience is experienced by reason of the tendency of the closure to assume a tilted position on the container thread. Such tendency is the result of a mismatch of the closure thread and the container thread, when the closure is drawn out from the feed chute. Difficulty is then experienced when the container and closure is forwarded to the spinning head, employed to tighten down the cap on the container thread. In current installations this can result in jamming of caps; it is then found necessary to stop the machinery to free such caps on the containers.

It is an object of the present invention to provide a means for applying pre-threaded caps which can run substantially unattended and with a much reduced risk of jamming.

We have now found that the problem of tilted caps is almost wholly overcome by a system in which a cap is picked up by an overhead member which travels synchronously with the container and progressively lowers the cap onto the container while holding the cap level in relation to the container and approximately co-axial with the container neck. When the cap is brought down over the container mouth, the cap is spun in the tightening direction to screw it onto the container. The capped container may then be transferred to a spinning head for final tightening of the cap. However in many cases, particularly when the contents of the container are to be held at ambient atmospheric pressure, the apparatus of the invention may be employed as the sole means for screwing the cap onto the container.

The overhead pick-up member is preferably rotated to effect the initial turning of the cap. Alternatively the cap itself may be directly driven, for example by contact with a stationary friction or toothed member or rotating wheel.

The overhead pick-up member is preferably carried in a horizontal circular path by a turret. The pick-up member is preferably a vacuum pad, carried on the lower end of a shaft, which is slidably mounted for vertical movement in the turret, and also arranged for rotation in the turret, which is itself arranged co-axially with a star-wheel for driving the bottles.

The rotation of the pick-up member is preferably achieved by engagement of a drive wheel on its upper end with a stationary arcuate friction plate or toothed plate. As an alternative the cap may itself be turned by engagement with the friction plate. In such case the cap may itself be turned in relation to the vacuum pad.

The vacuum pad is preferably arranged to pick up a cap which has been fed from a cap feed chute and to remain engaged with the cap until the container reaches a point where it is released from the co-axial starwheel for transfer to a second starwheel which carries it forward possibly under a spinning head for final tightening.

The cap pick-up member is preferably supported at a controlled level throughout its path, except in that portion of its path where the cap is in place on the container. In that portion of its path the cap pick-up member is preferably left floating so that it may follow the cap downwardly as it is screwed onto the container thread.

While suction may be applied through the pick-up member throughout its orbital path, suction may be switched off from the pick-up member at a point where the prescrewing is completed, so as to release the cap completely from the pick-up member at or before the point where transfer to a second starwheel or discharge means takes place.

In the accompanying drawings

Figure 2:
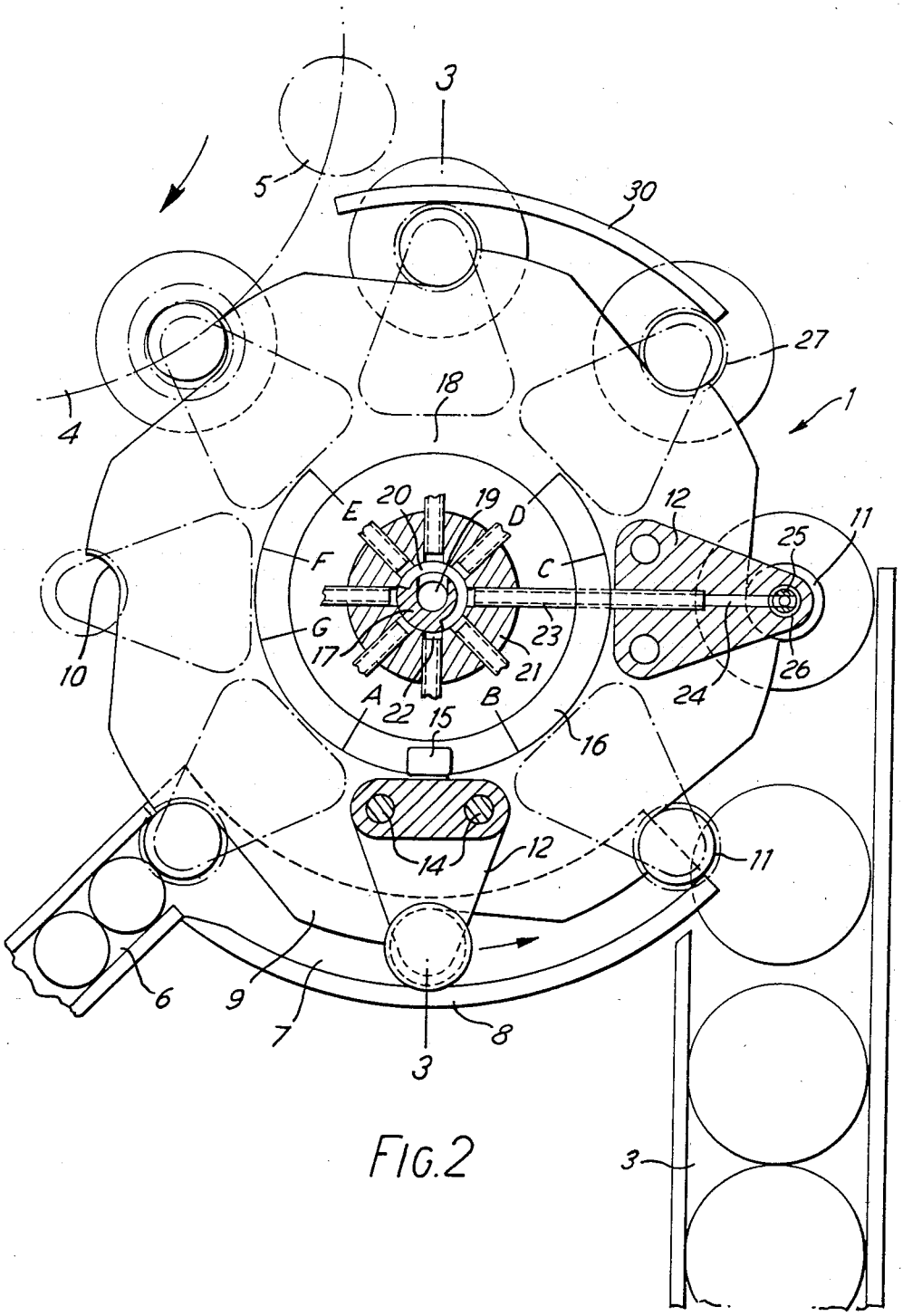
Figure 3:
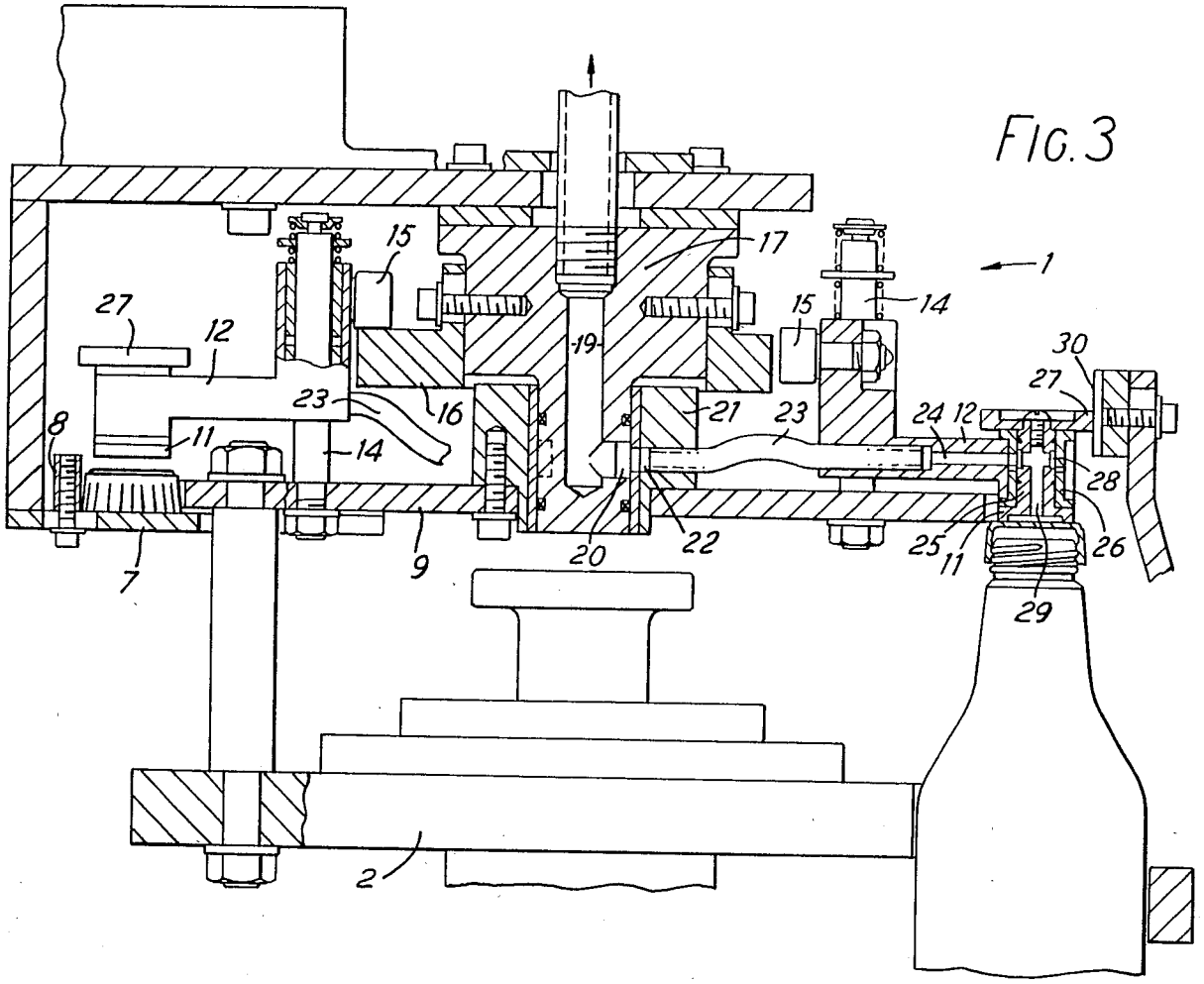
Figure 4:
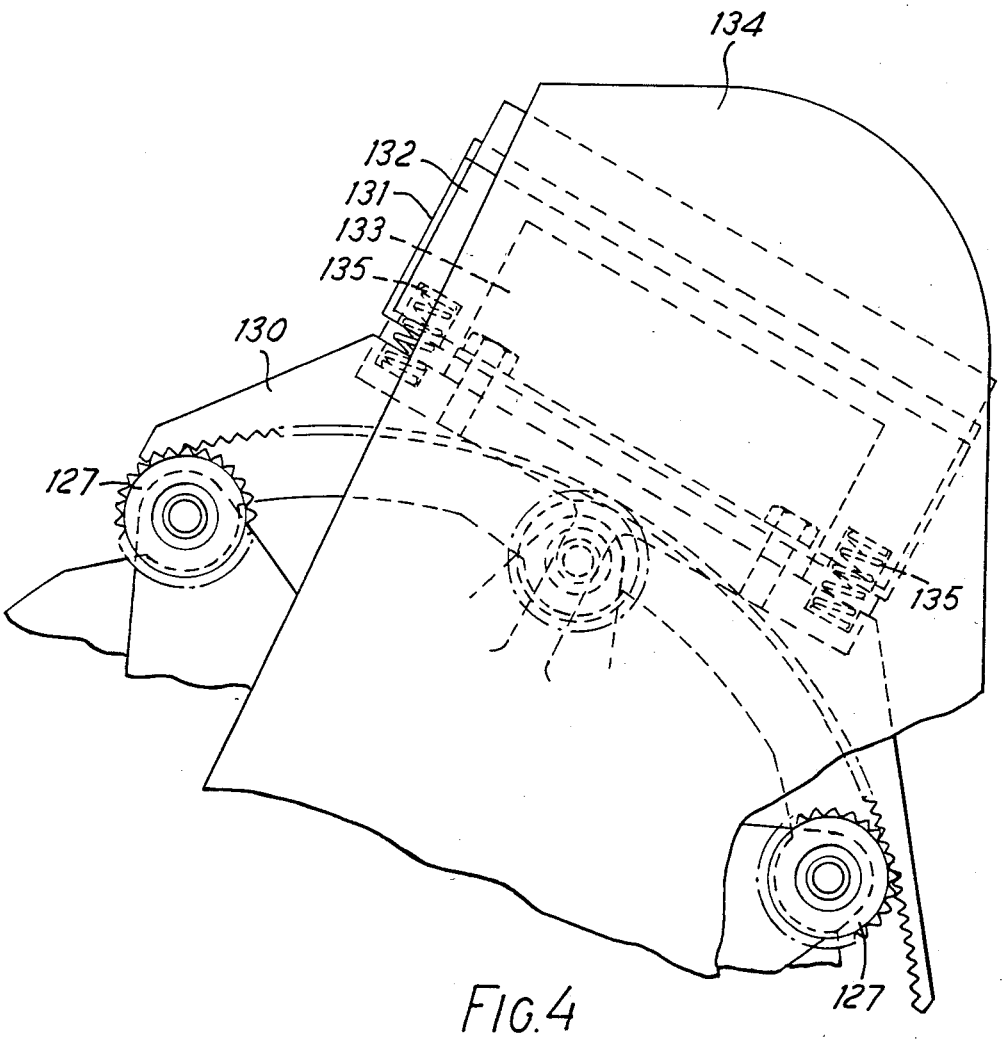

FIG. 1 diagrammatically illustrates the path of a cap pick-up head and the profile of the cam track controlling its vertical movement, FIG. 2 is a semi-diagrammatic plan view of the pick-up head turret and associated assemblies, FIG. 3 is a vertical axial section on line 3—3 in FIG. 2, FIG. 4 is a plan view of a modified form of drive for rotation of the vacuum pads.

The pick-up head turret 1, shown in FIGS. 2 and 3, is supported by and driven by a co-axial starwheel 2, shown in FIG. 3.

Bottles or other containers are delivered sequentially to starwheel 2 in conventional manner by a bottle feed conveyor 3 or other conventional bottle feed. The bottles are transferred sequentially from starwheel 2 to a starwheel 4, which is co-axial and synchronised with a turret (not shown) carrying the spinning heads 5, by which the caps are to be tightened on the bottles.

Prethreaded caps are fed to the turret 1 by means of a cap feed chute 6 (FIG. 2), which is preferably interlinked with a detector (not shown) inspecting the bottle feed conveyor to detect a gap in the supply of bottles. In the event of such a gap the supply of caps to the turret 1 is interrupted.

The cap feed chute 6 is connected to a stationary horizontal plate 7 and arcuate guide plate 8. The caps are picked up sequentially from the feed chute 6 by a star wheel 9, forming part of the turret 1, and are progressed sequentially along the plate 7, in which they are held at a defined position in relation to the central axis of the turret by the co-operation of the shape of the individual, cup-receiving recesses 10 in starwheel 9 in co-operation with the arcuate guide plate 8.

During travel along the plate 7 a suction pick-up head 11 descends onto the cap, so that on reaching the end of plate 7 the cap is supported on the lower face of the pick-up head 11 in an essentially horizontal position.

Each pick-up head 11 is carried by a support bracket 12, which is mounted for vertical movement on a pair of guide posts 14. The guide posts 14 are mounted at equiangular positions on the starwheel 9. Each bracket 12 is provided with a cam roller 15, which follows a stationary cam track 16 to effect vertical movement of the associated bracket 12 during rotation of starwheel 9 about the axis of a stationary spindle 17. The cam track is non-continuous as earlier explained and a gap is formed at 18 to allow the bracket 12 to descend freely while it is turned through about 90° about the axis of the spindle 17.

The spindle 17 has an axial suction passage 19, which communicates with a part-circular peripheral gallery 20 lying within a hub member 21, secured to starwheel 9. The hub member 21 is provided with radial suction passages 22, in each of which a flexible hose 23 is mounted for connection with a suction passage 24 in a pick-up head support bracket 12. Each pick-up head 11 is carried by a hollow spindle 25, mounted in a bush 26 in a bracket 12 and carrying a friction drive wheel 27 at its upper end. The spindle 25 has a peripheral gallery 28 leading into the axial passage 29 of the spindle and communicating with the suction passage 24 in bracket 12.

It will be seen that suction is applied at the lower face of the pick-up head during that part of each cycle where the associated suction passage 22 registers with the part circular gallery 20, irrespective of the vertical movement of the bracket 12 and rotation of the spindle 25.

A development of the cam track 16 is shown in FIG. 1 and its relationship with the suction gallery 20 is shown in FIG. 2. At station A, shortly after supply of a cap from the cap feed chute 6, the pick-up head 11 is clear of the top of the cap. As it travels from station A to station B head 11 descends onto the cap and at station B the associated suction passage 22 comes into register with gallery 20 to switch on the suction to pick up the cap, so that at the end of the plate 7 the cap is supported beneath the suction pick-up head 11. Between stations C and D the pick-up head descends onto the bottle and the cam roller 15 leaves the cam track 16.

At station D the friction wheel 27 comes into contact with a stationary arcuate friction plate 30. As the wheel 27 rolls along the friction plate 30, the spindle 25 and pick-up head 11 turn to run the cap down the neck thread of the underlying container driven by starwheel 2.

The cam track 16 picks up the cam roller 15 at station E. The associated suction passage 22 reaches the end of gallery 20 before reaching station F, at which the container is transferred to the starwheel 4. Since suction has been switched off before reaching station F, the cap is free to move laterally in relation to the pick-up head 11 at this point.

Between station F and station G the pick-up head 11 is lifted to its original level before reaching station A at the beginning of the next cycle.

The essential feature of this sequence of operations is the maintenance of the cap in a level position by the pick-up head as it is carried from the feed chute, lowered onto the container neck and pre-screwed onto the container neck.

While it is possible to envisage the pick-up and lowering of the cap while engaged by a mechanical gripper and its rotation through a mechanical gripper, the engagement of the cap by suction forces is greatly to be preferred, both during the suspension of the cap beneath the pick-up head and the subsequent rotation of the cap to run it down the neck thread.

As will be understood from the foregoing in some instances, particularly for containers of non-pressurised liquids the caps may be sufficiently tightened by the rotation imparted by engagement of the wheel 27 with the friction plate 30. In such case starwheel 4 acts only as a means for discharging the containers from starwheel 2 and the associated spinning heads may be omitted. Starwheel 4 may be replaced by other discharge means.

In some instances it is preferred to provide a more positive drive for the pick-up heads 11, particularly where it is desired to rotate the pick-up head through a predetermined angle, particularly through a predetermined number of revolutions. In such case toothed wheels 127 are mounted on the spindles 25 for co-operation with and engagement by an arcuate toothed rack 130.

The rack 130 has a tail 131 slidably mounted in a fixed support 132, which is supported by a bracket 133 carried by an overhead structure 134. The rack 130 is pressed outwardly against the toothed wheels by a pair of compression springs 135, which allow the rack 130 to yield in the event of mismatch between the teeth on wheels 127 and the teeth on rack 130. It will be understood that the teeth on both members are very shallow and of small angular extent.

As an alternative to interruption to the feed of caps via chute 6, as suggested above, in the event of a gap in the supply of bottles to starwheel 2, the application of suction to the pick-up heads 11 may be continued throughout the cycle or at least until the region of station F. At that location any unapplied cap may be removed from the pick-up head either by interruption of the suction to the pick-up head or by means of a mechanical knock-off device, (not shown), which physically separates an unapplied cap from the pick-up head.

In the described apparatus there is an interruption in the cam track between the stations D and E. During travel between these points a pick-up head 11 and its associated support bracket 12 are normally supported by the bottle, to which a cap is being applied. However in the absence of a bottle the bracket descends onto the starwheel 9 or, alternatively, onto a collar (not shown) arranged around the lower end of the guide post 14.

In a further alternative construction the rotation of the closure caps in the tightening direction may be achieved by rotating the cap or the pick-up head by means of a drive belt or the like in place of the stationary friction plate 30.

I claim:

1. A device for placing internally screw-threaded closure caps on externally screw-threaded containers and engaging said caps with the container thread comprising a feed chute for such closure caps, a closure cap feedwheel mounted for rotation about a vertical axis and having recesses spaced apart along its periphery and arranged to withdraw closure caps sequentially from said feed chute and to drive the caps in a horizontal part-circular path in spaced relation to one another, a series of pick-up members mounted for movement in a circular path coaxial with said part-circular path and being respectively mounted in axial alignment with said recesses each of which pick-up members is rotatable about and vertically movable in relation to its own axis which axis is parallel to said vertical axis, each of said pick-up members being adapted to pick-up a container cap from the associated aligned recess in the feedwheel and to hold such cap in a substantially horizontal position, a rotary drive wheel arranged to drive a series of spaced containers in an arc with the axis of each container substantially aligned with the axis of one of said pick-up members, means for raising and lowering the pick-up members during movement thereof with the feedwheel about said vertical axis and arranged for lowering each pick-up, member onto a container cap travelling in said part-circular horizontal path after withdrawal from said feed chute, carrying the cap forward to a position over a container, lowering the cap onto a container at a closure application station end, after the closure cap has been engaged with the container thread, raising the pick-up member to its starting height, and means for rotating the pick-up members and the closure caps carried thereby in a tightening direction after the caps have been lowered onto the containers.

2. A device according to claim 1, wherein said means for rotating the closure caps comprises a drive wheel mounted co-axially with each pick-up member and stationary arcuate member located at the closure application station, said drive wheel being arranged for rolling engagement with said arcuate member.

3. A device according to claim 1 further including a turret for supporting said pick-up members, each of said pick-up members being rotably supported in a bracket member which is vertically movable in relation to said turret, each bracket member being rotable about the axis of the turret including a cam follower engaging with a stationary cam track for raising and lowering the associated pick-up member.

4. A device according to claim 3 in which the cam track is interrupted at the closure cap application station.

5. A device according to claim 3 in which the closure cap feedwheel constitutes the drive for said bracket members.

6. A device according to claim 1 in which each pick-up member is a suction head.

7. A device according to claim 6 in which a suction passage in each pick-up member communicates with a part circular suction gallery in a stationary axial member, about which said pick-up member orbits, whereby suction is disconnected from the pick-up member during a predetermined interval in each cycle.

8. A device according to claim 1 in which said closure cap feed wheel is directly coupled to and supported by the container drive wheel.

9. A device for placing internally screw-threaded closure caps on externally screw-theaded containers and engaging said caps with the container thread comprising a feed chute for such closure caps, a closure cap feedwheel mounted for rotation about a vertical axis and having recessed spaced apart along its periphery and arranged to withdraw closure caps sequentially from said feed chute and to drive the caps in a horizontal part-circular path in spaced relation to one another, a series of pick-up members mounted on the feedwheel for rotation therewith about said vertical axis, said pick-up members being disposed in axial alignment with the respective recesses in the feedwheel and being adapted to pick up a container cap in the respective associated aligned recesses in the feedwheel and to hold such cap in a horizontal position, each of said pick-up members being also rotatable about and vertically movable in relation to its own axis, which axis is parallel to said vertical axis, a rotary drive wheel mounted for rotation about said vertical axis and having said feedwheel secured thereto said rotary drive wheel being arranged to drive a series of spaced containers in an arc with the axis of each container substantially aligned with the axis of one of said pick-up members, means for raising and lowering the pick-up members during movement thereof with the feedwheel about said vertical axis and arranged for lowering each pick-up member onto a container cap travelling in said part-circular horizontal path after withdrawal from said feed chute, carrying the cap forward to a position over a container, lowering the cap onto a container at a closure application station and, after the closure cap has been engaged with the container thread, raising the pick-up member to its starting height, and means for rotating the pick-up members and the closure caps carried thereby in a tightening direction after the caps have been lowered onto the containers.

* * * * *